US005678530A

United States Patent [19]

Van Drielen

[11] Patent Number: 5,678,530

[45] Date of Patent: Oct. 21, 1997

[54] ARROW REST

[76] Inventor: Thomas R. Van Drielen, 2885 C Aiello Dr., San Jose, Calif. 95111

[21] Appl. No.: 691,556

[22] Filed: Aug. 2, 1996

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 1,847,593 | 3/1932 | Cameron . | |
| 3,455,288 | 7/1969 | Knerr . | |
| 4,282,850 | 8/1981 | Warnicke | 124/24.1 |
| 4,372,282 | 2/1983 | Sanders | 124/24.1 |
| 4,662,346 | 5/1987 | Laffin | 124/44.5 |
| 4,686,956 | 8/1987 | Troncosco, Jr. | 124/44.5 |
| 4,748,964 | 6/1988 | Troncoso | 124/44.5 |
| 4,827,895 | 5/1989 | Troncosco, Jr. | 124/44.5 |
| 4,838,237 | 6/1989 | Cliburn | 124/44.5 |
| 4,873,963 | 10/1989 | Lemmen | 124/44.5 X |
| 4,917,072 | 4/1990 | Chang | 124/44.5 |
| 4,949,699 | 8/1990 | Gerber | 124/44.5 |
| 5,025,773 | 6/1991 | Hintze et al. | 124/44.5 |
| 5,190,023 | 3/1993 | Sacco | 124/44.5 |
| 5,456,242 | 10/1995 | Ruholl | 124/44.5 |
| 5,460,153 | 10/1995 | Huntt | 124/44.5 |

*Primary Examiner*—John A. Ricci

[57] ABSTRACT

An arrow rest for use with an archery bow comprises a flexible planar member in which a dislodged arrow is gravitationally urged down repositioning edges toward the launch position. Upwardly extending arms prevent horizontal exit of a dislodged arrow and return a dislodged arrow to the repositioning edges for gravitational urging toward launch position. An enclosing arm connects the upwardly extending arms to prevent vertical exit of a dislodged arrow and to return a dislodged arrow to the repositioning edges for gravitational urging toward launch position. An embodiment provides for lateral insertion of an arrow through a flexible gap in the enclosing arm. An embodiment of a launch position provides a common axial centerline for a wide range of diameters of arrows.

4 Claims, 5 Drawing Sheets

ARROW REST

FIELD OF THE INVENTION

This invention relates to archery equipment in general and more particularly to an improved archery bow arrow rest.

DESCRIPTION OF PRIOR ART

Trembling or shaking due to weak muscles, cold weather, or excitement, can easily dislodge an arrow from the launch position. Available arrow rests do not gravitationally urge a dislodged arrow toward the launch position. Safety features are not integral to the arrow rest, but are supplementary attachments to the bow. Arrow rests without adjustable launch positions can not suitably position all diameters of commercially available arrows.

An arrow rest attaches to an archery bow and locates the arrow in launch position while the archer pulls the bow and launches the arrow. Launch position is defined as the location at which an arrow is in contact with the positioning points of an arrow rest while the arrow is nocked to the bow string. When an arrow does not contact the positioning points of an arrow rest, the arrow is not in launch position. An arrow that is either misplaced or unintentionally moved away from the launch position is a dislodged arrow. A dislodged arrow poses a variety of hazards.

Beginning archers can release a dislodged arrow that is failing away from the launch position. When a dislodged arrow is launched, the arrow can fly as much as forty five degrees away from the intended target. Archery shops have arrow holes in the side walls of archery shooting lanes as mute testimony to dislodged arrows.

The point of a hunting arrow has razor sharp knife edges which increase any potential hazard from a dislodged arrow. When a bow is at full draw, the sharp hunting point is in close proximity to the hunter's forearm. Should a hunting arrow dislodge at full draw, the sharp point could easily injure the archer.

Currently, only restraining, or gripping, type arrow rests provide safety from injury by dislodged hunting arrows. However, restraining, or gripping, arrow rests do not provide the free exit of the arrow necessary for accurate arrow flight. Consequently, most hunting archers use a balancing type arrow rest which increases the potential for injury.

A balancing arrow rest does not restrain or grip the arrow. The arrow can easily fall off the rest. Consequently, safety gates or retainers, which are not part of the arrow rest, are added to hunting bows to prevent the sharp point of a hunting arrow from contacting the archer. No balancing arrow rest is currently available which provides integral safety features.

When an arrow is dislodged from launch position on an arrow rest, an archer must relax the bow, and manually reposition the arrow. Arrow rests provide no means by which a deflected arrow can be gravitationally repositioned while the bow is at rest, partially drawn, or fully drawn.

An arrow rest commonly provides a launch position by stabilizing an arrow on two small balancing points which radially contact the arrow. The maximum and minimum diameter of an arrow suitable for positioning in a balancing arrow rest is dependent upon the distance between the two small balancing points. The closer the two small balancing points, the smaller the arrow. The farther apart the small balancing points, the larger the arrow. Positioning a small arrow on an arrow rest designed for a large arrow would allow the small arrow to fall between the small balancing points of the arrow rest. Conversely, a large arrow positioned on an arrow rest designed for small arrows would be unstable and easily dislodged. An embodiment of this arrow rest provides excellent launch positioning for a wide range of arrow diameters.

Arrow rests can be described as balancing or retaining. Balancing arrow rests literally balance an arrow on two points radially positioned on the arrow. Retaining arrow rests provide one or more features which prevent lateral movement of the arrow. Previous art can be categorized into either balancing or retaining arrow rests.

With a balancing type arrow rest, lateral arrow movement greater than one half of the diameter of the arrow causes a dislodged arrow. U.S. Pat. No. 4,838,237 (Cliburn, 1989) is an example of a balancing arrow rest. Cliburn's arrow rest balances the arrow on the curved tips of two independently deflecting fingers. During operation, the bow is normally held in the shooting position, out in front of the archer. The bowstring is then pulled smoothly to prevent shaking the bow. Shaking the bow would cause the arrow to dislodge from the launch position. Shaking or jerking a bow is a common occurrence.

Beginning archers have not strengthened the muscles used to pull a bow which causes a jerky pull on the bow string. Even experienced archers can jerk or shake the bow due to tired muscle, shivering from the cold, or excitement. Even a strong gusty cross wind has been known to dislodge an arrow from a balancing type arrow rest. Cliburn's rest does not gravitationally reposition a dislodged arrow. Cliburn's arrow rest does not include safety features for protection from the razor sharp arrow points used by hunting archers.

Since a dislodged arrow is such a common occurrence, several patents attempt to prevent arrow dislodgment by retaining the arrow. Typically, the intent is to prevent dislodgment rather than allow dislodgment and then gravitationally reposition a dislodged arrow.

U.S. Pat. No. 4,827,895 (Troncosco, Jr., 1989) shows a retaining arrow rest with two blades. The upper blade is the arrow rest. The lower blade is the arrow retainer. The smaller upper blade is notched in such a manner as to provide two points for contact with the arrow. The larger lower blade is notched and bent to form fines that extend upwardly on both sides of the arrow. The lower blade retains the arrow with intent to prevent dislodgment of the arrow. Dislodgment would occur in response to a vertical, or near vertical movement, such as a rapid downward movement of the bow. The force of inertia on the arrow would cause the arrow to dislodge. An arrow dislodged in this manner would not be gravitationally repositioned. Troncosco's arrow rest would require additional safety devices for hunting archers.

U.S. Pat. No. 4,662,346 (Laffin, 1987) discloses an arrow gripping device which retains the arrow against an arrow rest, which is not part of the patent. The Laffin device is a supplementary retaining device, not an arrow rest. The force required for dislodgment would be equal to the force required for insertion of the arrow into the device. The device does not reposition a dislodged arrow. The device does not provide safety features.

U.S. Pat. No. 5,025,773 (Hintze 1991) discloses a retaining type arrow rest in which two points provide a launch position while a resilient third point is used to retain the arrow. An arrow can be dislodged by a force equal to the insertion force. The device does not gravitationally reposition a dislodged arrow.

U.S. Pat. No. 4,917,072 (Chang 1990) discloses a retaining type arrow rest, which includes a sighting device. The device prevents dislodgement of an arrow. The device does not gravitationally reposition a dislodged arrow.

U.S. Pat. No. 4,372,282 (Sanders 1983) discloses a retaining arrow rest. A lateral force on the arrow, greater than the retentive force of the device, could dislodge an arrow. The device does not gravitationally reposition a dislodged arrow.

U.S. Pat. No. 4,686,956 (Troncosco, Jr. 1987) discloses a two piece construction retaining arrow rest. The device uses wire grippers contacting an arrow to limit dislodgment of an arrow. An arrow could be dislodged by a near vertical force greater than the gripping force of the retaining wire grippers. An arrow could be dislodged by a horizontal force greater than the spring tension inherent in the retaining wire arms of the grippers. The device does not gravitationally reposition a dislodged arrow. The device does not include safety features to prevent a dislodged arrow from endangering a hunting archer.

U.S. Pat. No. 4,949,699 (Gerber 1990) discloses an arrow retention device. The device is not an arrow rest. The device is articulated away from the retaining position prior to launching an arrow. From the time the device is moved away from the retaining position to when the arrow exits the bow, the device provides no retention.

U.S. Pat. No. 4,282,850 (Warnicke 1981) discloses an archery bow with the handle formed to receive a retaining arrow rest. The arrow rest does not attach to commercially available archery bows. An arrow would be dislodged by a force greater than the retaining force of the arrow gripping fins. The device does not gravitationally reposition a dislodged arrow.

U.S. Pat. No. 1,847,593 (Cameron 1932) shows an archery bow with the handle enclosing a balancing type arrow rest. The arrow rest does not attach to commercially available archery bows. An arrow would be dislodged by tilting the bow or by bouncing the bow. The device does not gravitationally reposition a dislodged arrow.

U.S. Pat. No. 3,455,288 (Knerr 1966) shows an archery bow with the handle modified to provide a hole for the shaft of the arrow, and slots for the vanes of the arrow. The arrow rest is integral to the bow, and does not attach to commercially available archery bows. The arrow rest is a retaining device, preventing dislodgment of an arrow. The device does not gravitationally reposition a dislodged arrow.

U.S. Pat. No. 4,748,964 (Troncosco 1988) shows a balancing arrow rest. An arrow is balanced between a bolt situated radially to the arrow, and an elongated plate situated axially to the arrow. Dislodgment of the arrow would occur with any rapid, or jerky, movement of the bow. The arrow rest would not gravitationally urge a dislodged arrow toward the launch position. The arrow rest would require additional safety devices for hunting archers.

U.S. Pat. No. 5,456,242 (Ruholl, 1995) and U.S. Pat. No. 5,460,153 (Huntt, 1995) show retaining type arrow rests. These arrow rests inhibit dislodgment of an arrow. These arrow rests do not gravitationally urge a dislodged arrow toward launch position.

U.S. Pat. No. 4,873,963 (Lemmen, 1989) shows an arrow sling device with a gated arrow rest. Sloped upper edges of the gated arrow rest are described as assisting the initial positioning of an arrow. The sloped upper edges are not described as repositioning devices because any movement of the gates would negate potential repositioning. A dislodged arrow striking the gates with a force equal to or greater than the closing force of the gates, can open the gates, allowing the arrow to fall between the gates. After an arrow has fallen between the gates, the sloped upper edges of the device cannot gravitationally urge an arrow back to launch position. To reposition a dislodged arrow, the archer must relax the device and manually move the arrow. The device does not allow an archer to move from the fully drawn position, to the fully relaxed position, and then immediately return to fully drawn position. Commonly, an archer is at full draw and does not find conditions suitable for launching an arrow. The archer returns the device to the relaxed position. During the movement from full draw to relaxed, the forward moving arrow would open the gates, allowing the arrow to drop between the gates. Should the archer immediately attempt to return to full draw with the arrow positioned between the gates, the gates would attempt to close upon the arrow, gripping the arrow, and inhibiting the motion of the arrow. The device does not allow an archer to gravitationally urge a dislodged arrow to launch position whether the device is at rest, at partial draw, or at full draw. Additionally, the sloped upper edges do not prevent a dislodged arrow from exiting the device, requiring additional safety devices for hunting archers.

Special reference is here made to abandoned patent application Ser. No. 07/859/824 (Van Drielen Mar. 30, 1992. The following patent was filed after the date of the above abandoned application. The following patent is included to assure full disclosure.

U.S. Pat. No. 5,190,023 (Sacco 1993) discloses a retaining arrow rest. An arrow would be dislodged by a force greater than the retaining force. The device does not gravitationally reposition a dislodged arrow.

SUMMARY OF THE INVENTION

Since arrow dislodgment is such a common occurrence, it is reasonable to assume that dislodgment will occur. Since dislodgment can still occur with many retaining arrow rests which are intended to prevent dislodgment, then preventing dislodgment would appear to be of limited benefit. Rather than prevent dislodgment, this arrow rest assumes dislodgment will occur. When dislodgment occurs, this arrow rest gravitationally urges a dislodged arrow to return to the launch position.

An embodiment of this arrow rest provides safety from sharp hunting arrows by complete enclosure, or substantially complete enclosure, of the arrow.

An embodiment of this arrow rest can non-adjustably position a wide range of arrow diameters.

This arrow rest gravitationally repositions an arrow, whether the bow is at rest, being drawn, or at full draw. The need for an archer to relax the bow prior to repositioning a dislodged arrow is thereby eliminated.

This arrow rest allows an archer to keep both hands situated upon the bow while repositioning a dislodged arrow. Repositioning can occur while the bow is at full draw, being drawn, or relaxed, thereby reducing the recovery time due to a dislodged arrow.

This arrow rest gravitationally repositions an arrow when the arrow is laterally deflected a distance significantly greater than one half the diameter of the arrow. Thereby greatly increasing the distance of the dislodgment from which an arrow can be gravitationally urged to the launch position.

BRIEF DESCRIPTION OF THE DRAWINGS

Neither an archery bow, nor means of attachment to an archery bow, are illustrated in these figures as these procedures are well known to anyone knowledgeable in the art.

The means of attachment to an archery bow are not included in this patent application. A commercially available example of a mounting device is included for clarification only.

DETAILED DESCRIPTION OF THE PREFERRED EMBODIMENT

For simplification, a commercially available arrow with three vane fletch, having vanes oriented at the two o'clock, six o'clock, and ten o'clock positions, is used to describe the preferred embodiments. This arrow rest is not limited to a specific vane orientation. Additional embodiments would allow other quantities and orientations of vanes. Providing an embodiment for every conceivable vane configuration would not increase the understanding of this arrow rest.

Figure 1:
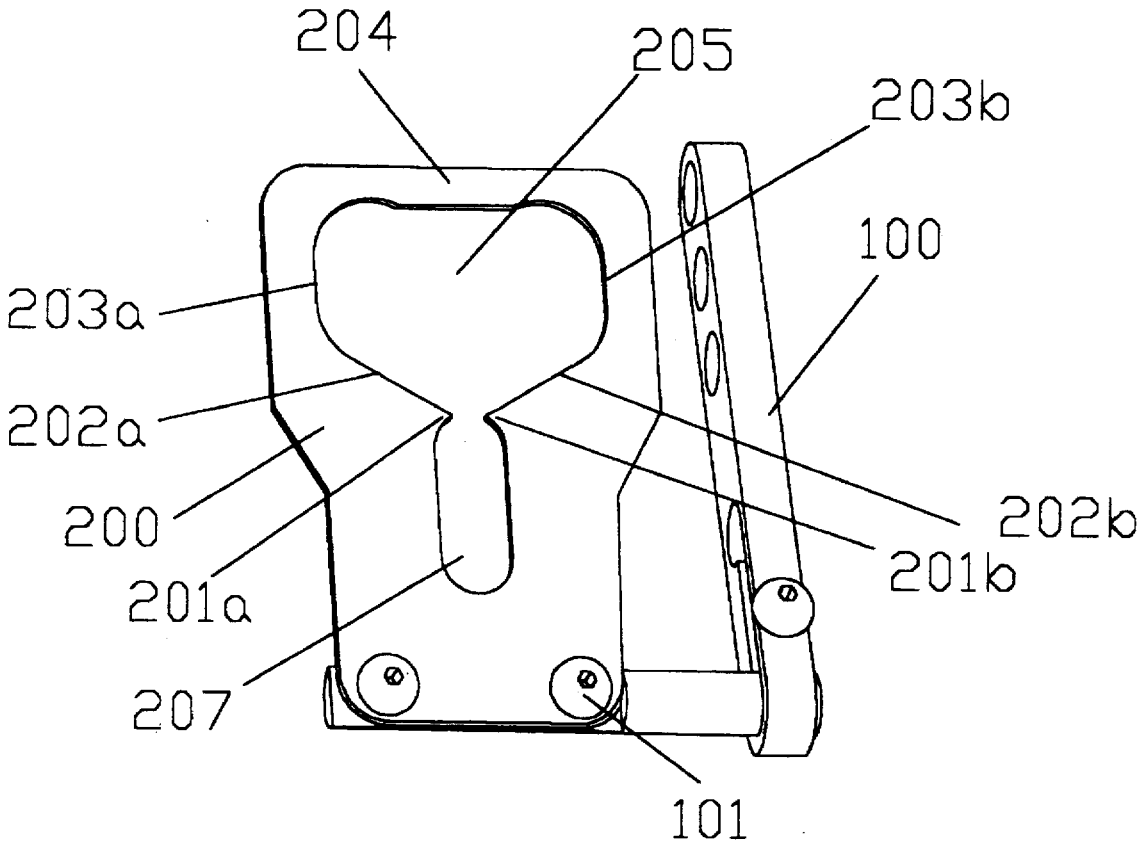
FIG. 1 shows complete enclosure of an arrow, requiting axial insertion of an arrow.
Figure 2:
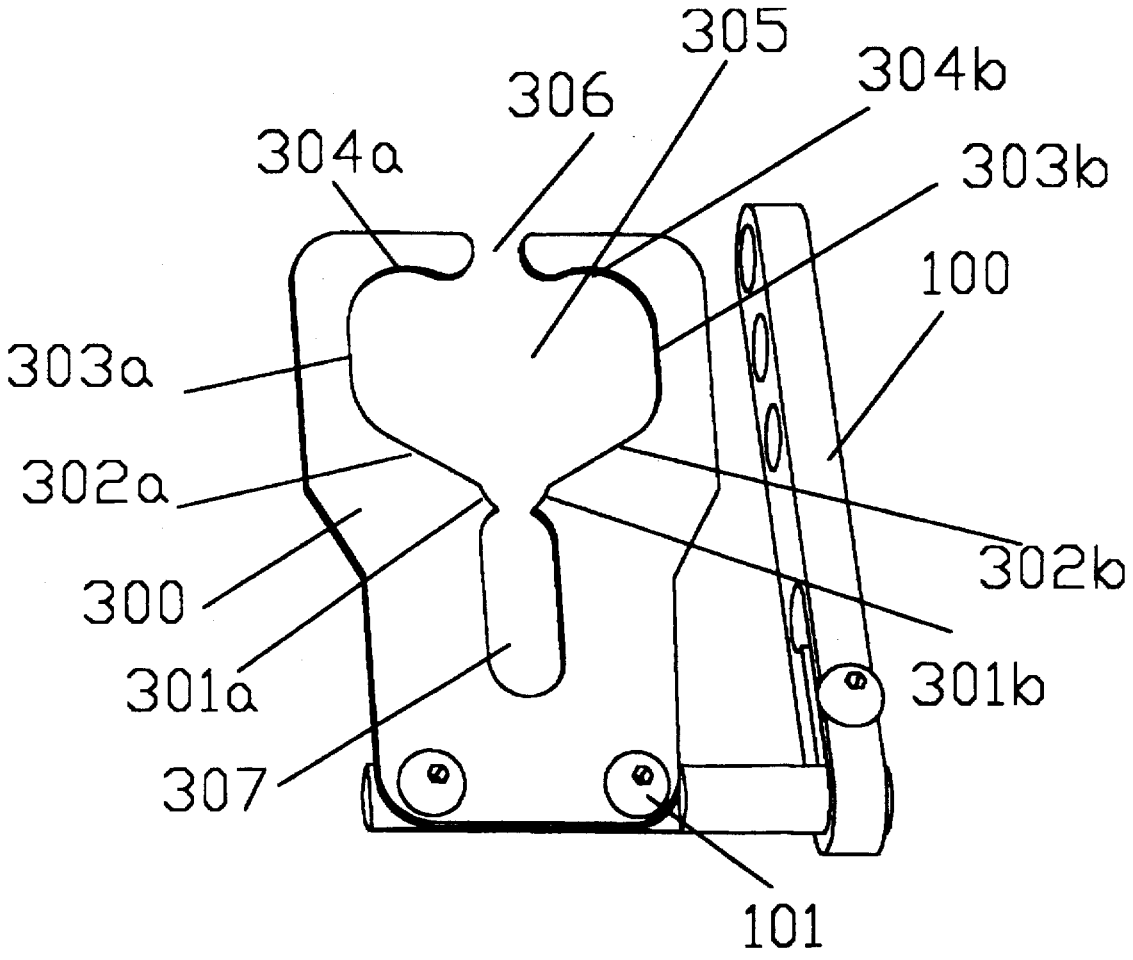
FIG. 2 shows partial enclosure of an arrow allowing lateral insertion of the arrow.
Figure 3:
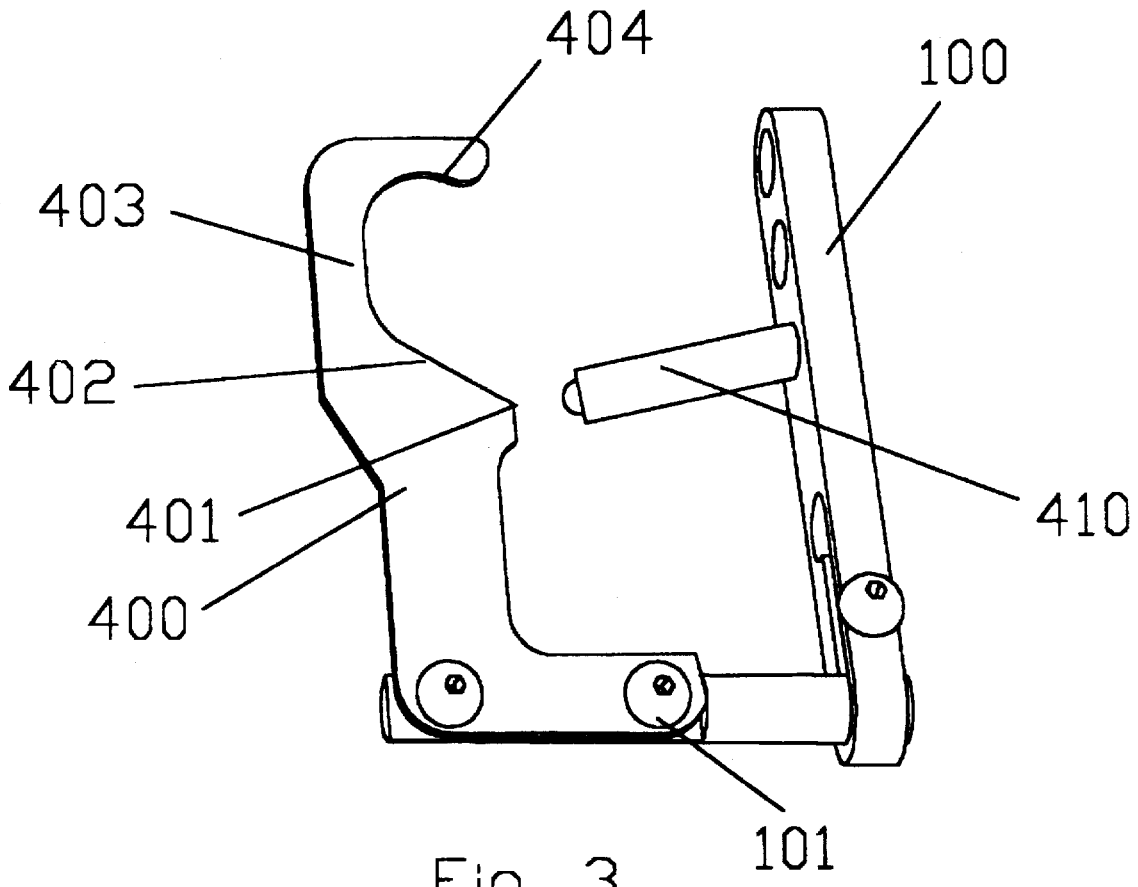
FIG. 3 shows a partial arrow rest as would be used with a spring plunger.

All the embodiments of this arrow rest shown in FIGS. 1 through 3 have certain commonalties. Therefore, it seems reasonable to describe the general features common to all the embodiments.

FIG. 1, FIG. 2, and FIG. 3 show the arrow rest embodiments 200, 300, and 400 attached to commercially available mounting device 100 with suitable screws 101. Neither a bow nor an arrow are shown since attachment to a bow and positioning of an arrow are generally known by a person knowledgeable in the art. Neither a bow, nor an arrow, nor a mounting device is included in the application.

FIG. 1, FIG. 2, and FIG. 3 show embodiments 200, 300, and 400 in which the arrow rest is generally a flat planar member, which is just one of many possible embodiments. Other embodiments could show the different requirements for various archers. The requirement of the archer influences choice of material, planar flatness of the material, and thickness of material. Quietness, wear resistance, fragility, and sturdiness influence the choice of material. Plastic would provide greater quietness than steel. Steel would be more wear resistant than plastic. Plastic coated wire would be quiet and wear resistant but more susceptible to damage from impact. Choice of material and shape of material are selected according to the requirements of the archer. Flexibility, durability, and quietness are not features included in this application. The following examples describe various differing requirements.

A hunting archer requires safety, quietness, and resistance to impact. Safety should be a primary requirement for a hunting archer because a sharp hunting arrow could impale an archer's arm. Quietness is also important, as a metallic noise of an aluminum arrow on a metal arrow rest would alarm the quarry. Since hunting archers frequently hunt from high up in a tree, a bow is occasionally dropped. An arrow rest for a hunter should provide impact resistance. Consequently, this arrow rest embodied for a hunting archer would comprise an arrow enclosing thick plastic planar member, providing safety, quietness, and impact resistance.

Safety and quietness are not important for tournament archers. A tournament archer shoots hundreds of arrows per day. Wear resistance would be more important than safety or quietness. An embodiment for Olympic type field tournament archer would be a curved thin steel planar member with short upwardly extending arms and without inwardly extending arms.

Some archers use the same bow for both tournaments and hunting. Dual purpose archers may prefer a double curved thin steel planar member. The lower portion of the rest would curve away from the archer allowing greater reactive movement away from the arrow for tournaments. The upwardly extending arms would be of sufficient length as to limit lateral arrow dislodgment for hunting.

When attached to a rigid mount, as shown in FIG. 1, FIG. 2, and FIG. 3, a thin flexible plastic, or thin sheet of spring tempered steel, would be the material of choice. Resiliency is needed when using a rigid mount.

When attached to a commercially available actuating mount, not shown, the material could be rigid metal or thick plastic. Resiliency would be provided by the actuating mount. The arrow rest could be molded, machined, stamped out of sheets, or formed with wire.

Consequently it can be seen that this arrow rest can be made from a wide variety of materials, by a wide variety of methods. The unique features of this arrow rest are functional, not material, nor method of manufacture. The figures and descriptions fully disclose how the arrow rest functions.

FIG. 1, an embodiment of the arrow rest 200 for axial insertion of an arrow includes, launch position edges 201*a* and 201*b*, repositioning edges 202*a* and 202*b*, upwardly extending arms 203*a* and 203*b*, enclosing arm 204, upper cavity 205, and lower cavity 207.

An arrow is inserted axially through the upper cavity 205. Gravity urges the arrow downwardly, contacting either repositioning edge 202*a* or 202*b*. Gravity urges the arrow to slide down either repositioning edge 202*a* or 202*b* toward contact with the launch position edges 201*a* and 201*b*. When the arrow simultaneously contacts launch position edges 201*a* and 201*b*, the arrow is in launch position. Launch position is described as an arrow in simultaneous contact with both launch position edges 201*a* and 201*b*.

When a three vaned arrow is launched, the two vanes oriented at 2 o'clock and 10 o'clock pass through the upper cavity 205, and the lower vane, oriented at 6 o'clock, passes through the lower cavity 207. A four vaned arrow would pass two vanes through the upper cavity 205 and two vanes through the lower cavity 207.

An arrow can be slightly dislodged from launch position. A slightly dislodged arrow is described as dislocated by a distance approximating the diameter of the arrow. A cross wind or trembling archer would provide sufficient force to slightly dislodge an arrow.

When an arrow is slightly dislodged, gravity urges the arrow to slide down the repositioning edges 202*a* or 202*b* toward launch position 201*a* and 201*b*. Response to gravitational urging occurs while the bow is at rest, partially drawn, or at full draw. The archer does not have to manually reposition a dislodged arrow.

An arrow can be forcefully dislodged. Examples of forceful dislodgment would be when the tip of the arrow snags on foliage, or when the archer makes a rapid downward movement with the bow.

When forcefully dislodged horizontally, such as snagging the arrow tip on foliage, the arrow moves into contact with either of the upwardly extending arms 203*a* or 203*b*. The upwardly extending arms 203*a* or 203*b* inhibit the horizontal movement of the arrow. Should the dislodging force on the arrow tip continue, the arrow would bend as it is forced against the upwardly extending arm 203*a* or 203*b*. When the horizontally dislocating force on the arrow releases, the stored energy in the bent arrow would cause the arrow to bounce back and forth within the upper cavity 205. As the bouncing slows, gravity urges the arrow into contact with a repositioning edge 202*a* or 202*b*. Gravity continues urging the arrow down the repositioning edges 202*a* or 202*b* until contact is made with launch position edges 201*a* and 201*b*. The arrow is now ready to launch.

When forcefully dislodged vertically, such as during a rapid downward movement of the bow, inertia causes the arrow to remain stationary. The arrow rest moves downwardly until the arrow contacts the enclosing arm 204. Upon contact with the enclosing arm 204, inertial movement of the arrow is inhibited. The arrow responds to the urging of gravity and falls onto either repositioning edge 202*a* or 202*b*. Gravity continues urging the arrow down the repositioning edge 202*a* or 202*b* until contact is made with launch position edges 201*a* and 201*b*. The arrow is now ready to launch.

FIG. 2 shows an embodiment of the arrow rest 300 for lateral arrow insertion. The arrow rest 300 includes launch position edges 301*a* and 302*b*, repositioning edges 302*a* and 302*b*, upwardly extending arms 303*a* and 303*b*, inwardly extending arms 304*a* and 304*b*, upper cavity 305, lateral insertion gap 306, and lower cavity 307.

An arrow is inserted into the arrow rest 300 by laterally forcing the arrow through the lateral insertion gap 306. The opening of the lateral insertion gap 306 is sufficiently small to allow smaller diameter arrows to snap through with sufficient force as to prevent an arrow from easily exiting through the lateral insertion gap 306. The material forming the inwardly extending arms 304*a* and 304*b* is sufficiently resilience as to allow larger diameter arrows to snap through the lateral insertion gap 306. After passing through the lateral insertion gap 306, the arrow falls downwardly toward either of the repositioning surfaces 302*a* or 302*b*. Gravity urges the arrow to slide down the repositioning edges 302*a* or 302*b* to contact the launch position edges 301*a* and 301*b*. When the arrow simultaneously contacts launch position edges 301*a* and 301*b*, the arrow is in launch position. Launch position is described as an arrow in contact with both launch position 301*a* and 301*b*. The arrow is now in launch position.

When a three vaned arrow is launched, the two vanes oriented at 2 o'clock and 10 o'clock pass through the upper cavity 305, and the lower vane, oriented at 6 o'clock, passes through the lower cavity 307. A four vaned arrow would pass two vanes through the upper cavity 305 and two vanes through the lower cavity 307.

An arrow can be slightly dislodged from launch position. A slightly dislodged arrow would be described as dislocated by a distance approximating the diameter of the arrow. A cross wind or trembling archer would provide sufficient force to slightly dislodge an arrow. When an arrow is slightly dislodged, gravity urges the arrow to slide down the repositioning edges 302*a* or 302*b* toward launch position 301*a* and 301*b*. Response to gravitational urging occurs while the bow is at rest, partially drawn, or at full draw. The archer does not have to manually reposition a dislodged arrow.

An arrow can be forcefully dislodged horizontally and vertically. Examples of forceful dislodgment would be when the tip of the arrow snags on foliage, or the archer makes a rapid downward movement with the bow.

When forcefully dislodged horizontally, such as snagging the arrow tip on foliage, the arrow moves into contact with either of the upwardly extending arms 303*a* or 303*b*. The upwardly extending arms 303*a* or 303*b* inhibit the horizontal movement of the arrow. Should the dislodging force on the arrow tip continue, the arrow would bend as it is forced against the upwardly extending arms 303*a* or 303*b*. When the horizontally dislocating force on the arrow releases, the stored energy in the bent arrow would cause the arrow to bounce back and forth within the upper cavity 305. As the bouncing slows, gravity urges the arrow into contact with the repositioning edges 302*a* or 302*b*. Gravity continues urging the arrow down the repositioning edges 302*a* or 302*b* until contact is made with launch position edges 301*a* and 301*b*. The arrow is now ready to launch.

When forcefully dislodged vertically such as during a rapid downward movement of the bow, inertia causes the arrow to remain stationary. Either the lateral insertion gap 306 or one of the inwardly extending arms 304*a* or 304*b* contact the arrow with the lateral insertion gap 306 or either inwardly extending arm 304*a* or 304*b*, the arrow's inertia is inhibited. The arrow responds to the urging of gravity and falls onto either repositioning edge 302*a* or 302*b*. Gravity continues urging the arrow down the repositioning edges 302*a* or 302*b* until contact is made with the launch position edges 301*a* and 301*b*. The arrow is now ready to launch.

Figure 2A:
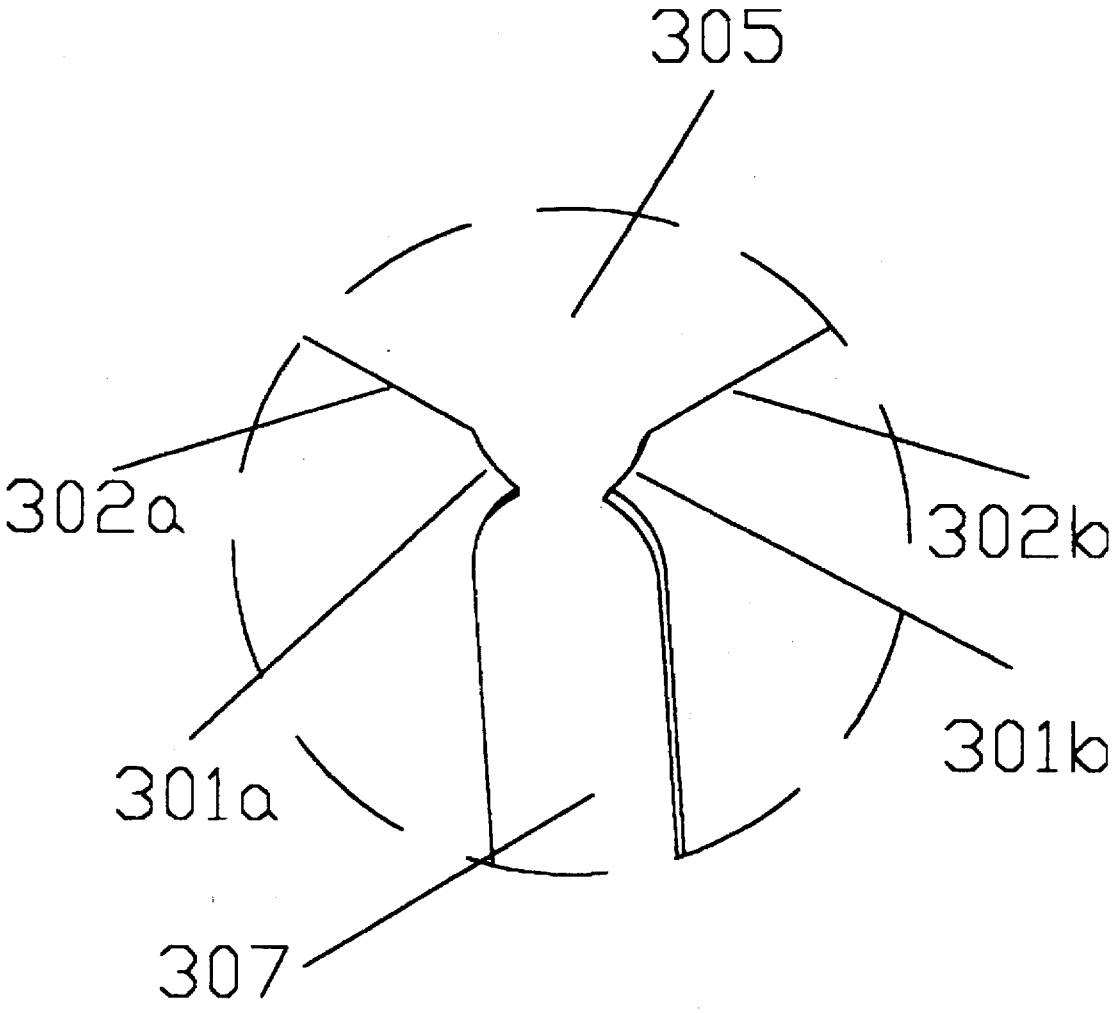
FIG. 2A shows an enlarged view of the launch position of FIG. 2.

FIG. 2 launch position edges 301*a* and 301*b* show an embodiment for receiving a wide variety of arrow diameters. FIG. 1 launch position edges 201*a* and 201*b* show an embodiment for receiving a limited variety of arrow diameters. To illustrate this difference, FIG. IA and FIG. 2A are compared.

Figure 1A:
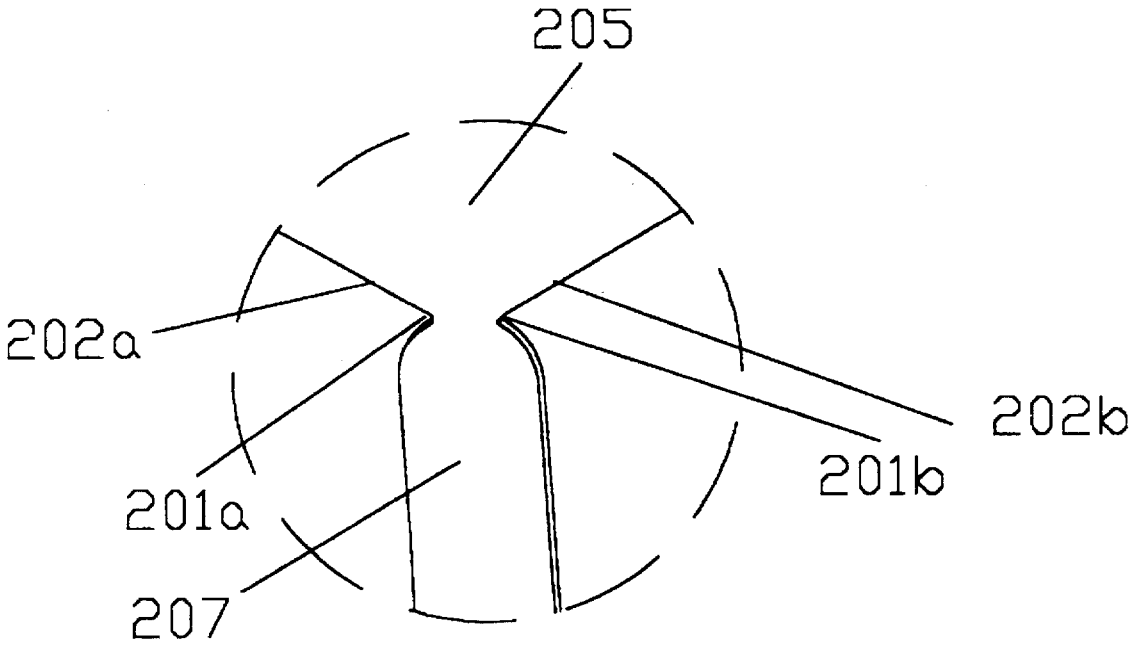
FIG. 1A shows an enlarged view of the launch position of FIG. 1.

FIG. 1A shows an embodiment wherein launch position edges 201*a* and 201*b* are formed by the intersections of the upper edges of the lower cavity 207 and repositioning edges 202*a* and 202*b*. Launch Position Edges 201*a* and 201*b* are not additional edges or surfaces connecting the upper edges of the lower cavity 207 and the repositioning edges 202*a* and 202*b*. Therefore, launch position edges 201*a* and 201*b* are two somewhat sharp points. The launch position of this embodiment is comparable to the launch position of most balancing type arrow rests and many retaining type arrow rests. On typical arrow rests, the variety of diameters of arrows suitable for placement in the launch position is limited by the width of the base of the vane and the width of the launch position.

A vane attaches to an arrow by bonding the base of the vane to the arrow shaft. Looking at an arrow axially, a vane would appear tee shaped. The cross bar of the tee shaped cross section of a vane would be quite short compared to the length of the tee. The base provides a larger surface for adhesion to the shaft. While vanes can easily pass through most arrow rests, the base of the vane will sometimes impact the arrow rest during launch of an arrow. The width of the launch position should be sufficiently wide to allow the base of a vane to pass through.

Width of the launch position limits the diameter of an arrow that may suitably be positioned. Should the launch position on a typical arrow rest be somewhat far apart, then small diameter arrows could fall through the launch position.

Consequently, it can be seen that the width of the arrow launch position limits the range of arrow diameters that can be suitably positioned for launch. FIG. 1A illustrates the launch position typical of balancing arrow rests.

In FIG. 1A, the size of the upper portion of the lower cavity 207 determines the maximum and minimum diameters of arrows suitable for placement in the launch position. When the distance from launch position 201*a* to launch position 201*b* is somewhat small, then large diameter arrows would contact the repositioning edges 202*a* and 202*b* rather than launch position edges 201*a* and 201*b*. Additionally, the base of the vane would not have adequate clearance to pass through without the base of the vane impacting the arrow rest. When the distance from launch position 201*a* to launch position 201*b* is somewhat large, then small diameter arrows could easily enter the lower cavity 207. A launch position allowing suitable nesting for a wide variety of arrow diameters is desirable.

Referring to FIG. 2A, launch position edges 301*a* and 301*b* allow for a wide range of arrow diameters by providing progressively increasing width of launch positions. The upper edges of the lower cavity 307 terminate a short distance away from the lower ends of the repositioning edges 302*a* and 302*b*.

Additionally, the distance between the upper edges of the lower cavity 307 is somewhat close. The distance between the upper edges of the lower cavity should be just large enough for the base of a small vane to pass through without contact. On vanes suitable for attachment to small diameter arrows, the base is slightly less than one eighth of an inch. Therefore, the distance between the upper edges of the lower cavity 307 would be approximately one eighth of an inch. On a typical arrow rest, if the launch position edges were approximately one eighth of an inch apart, the base of a large arrow would impact the arrow rest, Consequently, it can be seen that a typical arrow rest providing typical launch position edges can not suitably position a wide range of arrow diameters.

FIG. 2A illustrates a launch position providing arcs which allow additional clearance for large arrows while properly positioning small arrows. Launch Position Edges 301*a* and 301*b* are arcs with a radius larger than the largest commercially available arrow radius. The arc centers are offset toward the opposing launch position. The center of the arc forming launch position 301*a* is slightly above the upper end point of the arc forming launch position arc 301*b*. The center of the arc of launch position 301*b* is slightly above the upper end point of arc forming launch position 301*a*.

A disadvantage of typical arrow rests is bow manufacturers cannot provide a bow with an arrow rest attached and a fixed nock position for the arrow on the bow string. In order for a bow to accurately launch an arrow, the arrow rest must be positioned both horizontally and vertically. The arrow rest must position the arrow horizontally so the center of the movement of the bow string is centered on the arrow. The arrow rest must locate the arrow vertically in relationship to the arrow nocking position on the bow string. With a typical arrow rest, the vertical location of an arrow rest is related to the diameter of the arrow. The vertical location of the arrow moves upwardly for increasing arrow diameters, and downwardly for decreasing arrow diameters. Consequently, the nock location of the arrow on the bow string also has to change in order for the bow to accelerate an arrow in a straight line. In FIG. 2A, the radii and locations of the arcs forming the launch position edges 301*a* and 301*b* are situated so that the progressive increase in the separation of launch position edges 301*a* and 301*b* is directly proportional to an increase in arrow diameter. This feature allows all diameters of arrows to suitable position an mow without requiring adjustment to the nock location of the arrow on the bow string. This feature allows bow manufacturers to market a bow with arrow rest attached and a fixed arrow nocking position on the bow string that would accept any diameter of arrow.

Continuing with the description of FIG. 2A, when a somewhat small arrow is placed in launch position, the arrow locates toward the lower portion of launch position edges 301*a* and 301*b*. The base of the vane on a small arrow passes through the upper edges of the lower cavity 307. When a somewhat larger arrow is placed in launch position, the arrow nests toward the upper portion of launch position edges 301*a* and 301*b*. The base of the vane on a large arrow passes through the lower portion of the launch position edges 301*a* and 301*b*. The base of a large vane on a large arrow does not pass through the upper edges of the lower cavity 307. The launch position edges 301*a* and 301*b* are not limited to offset radii. Angled or convex edges would function nearly as well. This embodiment of the launch position provides vane base clearance for all commercially available diameters of arrow.

FIG. 3 shows an embodiment of this arrow rest 400 providing one launch position 401, one repositioning edge 402, one upwardly extending arm 403, one inwardly extending arm and a commercially available spring plunger 410. The spring plunger 410 is not part of this application and provides the other half of a typical launch position. The spring plunger 410 could also be a spring actuated arm, a coil spring, or resilient finger.

The embodiment of FIG. 3 illustrates just one of many possible embodiments for archers requiring a lesser amount of safety. An arrow is placed on repositioning edge 402. Gravity urges the arrow down repositioning edge 402 toward contact with launch position 401 and the spring plunger 410. The arrow is then positioned to launch.

FIG. 3 embodiment limits horizontal dislocation of an arrow. When an arrow is dislodged horizontally, the arrow contacts either the inwardly extending arm 404 or the upwardly extending arm 403. Movement is thus inhibited. Gravity urges the arrow into contact with launch position 401 and the spring plunger 410. The arrow is ready to launch.

Accordingly, it may be seen that the arrow rest of this invention can keep an arrow from laterally falling away from a bow, gravitationally reposition a dislodged arrow without an archer having to relax the bow or move either hand, integrally protect an archer's forearm from injury by a dislodged arrow, and suitably nest all diameters of commercially available arrows.

Although the description above contains many specificities, these should not be construed as limiting the scope of the invention but as merely providing illustrations of some of the presently preferred embodiments of this invention. For example, the arrow rest could be shaped to accommodate two, four or six fetch arrows. The shape of the launch position of the arrow rest could be formed to fit a specific arrow diameter. The arrow rest could be of curved planar shape rather than a fiat planar shape. The arrow rest could be made from wire, or other suitable material, to form the repositioning edges and launch position edges, with or without an upper cavity, with or without a lower cavity. The arrow rest could be attached directly to the bow, thereby eliminating commercially available mounting devices. The arrow rest could be made from various flexible materials and mounted on a rigid commercially available mount. The arrow rest could be made from various rigid materials and mounted on a commercially available articulating mounting device.

I claim:

1. An arrow rest, comprising:

a substantially flat planar member, said flat planar member having a portion cut out therefrom to form an upper cavity;

said upper cavity bounded on the left by a left upwardly extending arm, and on the right by a right upwardly extending arm;

said upper cavity having a lower portion including a left repositioning edge and a right repositioning edge;

said left repositioning edge extending from the lower portion of the left upwardly extending arm and angled downwardly toward the lower center of said upper cavity and terminating in a left launch position edge;

said right repositioning edge extending from the lower portion of the right upwardly extending arm and angled downwardly toward the lower center of said upper cavity and terminating in a right launch position edge;

said left and right launch position edges being separated by a distance less than a diameter of an arrow to be supported on said edges, a space between said edges defining a launch position;

said flat planar member further including a portion cut out to form a lower cavity;

said lower cavity located directly below and open to said launch position, and of size to accommodate an arrow fletching;

means to mount said flat planar member to an archery bow such that a nocked arrow will rest in said launch position, and if said arrow is dislodged from said launch position, the upwardly extending arms and repositioning edges will tend to direct the arrow back to the launch position.

2. The arrow rest of claim 1 in which said upper cavity is bounded on the top by an enclosing arm which connects the upper ends of the upwardly extending arms.

3. The arrow rest of claim 1 in which said upper cavity is bounded on the top by a left inwardly extending arm which extends from the upper end of the left upwardly extending arm toward the top center of the upper cavity, and a right inwardly extending arm which extends from the upper end of the right upwardly extending arm toward the top center of the upper cavity, the inwardly extending arms leaving a gap to allow insertion of an arrow into said upper cavity.

4. An arrow rest comprising:

a mounting device mountable to a bow;

a spring plunger mounted to said mounting device;

a substantially flat planar member mounted to said mounting device to one side of said spring plunger, said flat member comprising:

a launch position edge at the same elevation as the spring plunger and separated from the spring plunger by a distance less than the diameter of an arrow to define a launch position;

a repositioning edge angled outwardly and upwardly from the launch position edge;

an upwardly extending arm extending upwardly from the outer end of the repositioning edge;

an inwardly extending arm extending inwardly from the upper end of the upwardly extending arm;

such that a nocked arrow will rest in said launch position, and if said arrow is dislodged from said launch position, the upwardly extending arm and repositioning edge will tend to direct the arrow back to the launch position.

* * * * *